US008348822B1

(12) United States Patent
Govig

(10) Patent No.: US 8,348,822 B1
(45) Date of Patent: Jan. 8, 2013

(54) METHOD OF MANUFACTURING PACKING STRUCTURE

(76) Inventor: Michele MacCollum Govig, Phoenix, AZ (US)

( * ) Notice: Subject to any disclaimer, the term of this patent is extended or adjusted under 35 U.S.C. 154(b) by 0 days.

(21) Appl. No.: 13/399,582

(22) Filed: Feb. 17, 2012

Related U.S. Application Data

(62) Division of application No. 11/117,094, filed on Apr. 28, 2005, now Pat. No. 8,123,666.

(51) Int. Cl.
*B31C 1/04* (2006.01)

(52) U.S. Cl. ..... 493/967; 206/86; 206/99; 206/423; 206/521; 206/584

(58) Field of Classification Search ..... 493/967; 206/584, 86, 99, 521, 423; 428/402
See application file for complete search history.

(56) References Cited

U.S. PATENT DOCUMENTS

| | | | | |
|---|---|---|---|---|
| 2,271,180 | A | 5/1939 | Brugger | |
| 2,320,372 | A | 7/1940 | McCarthy | |
| 3,560,313 | A * | 2/1971 | Herkimer | 428/4 |
| 4,114,224 | A | 9/1978 | Disko | |
| 4,201,806 | A * | 5/1980 | Cole | 428/4 |
| 5,027,468 | A | 7/1991 | Leventhal et al. | |
| 5,221,124 | A | 6/1993 | Nichols | |
| 5,279,015 | A | 1/1994 | Meiring | |
| 5,601,886 | A | 2/1997 | Ishikawa et al. | |
| 5,643,647 | A | 7/1997 | Wischusen, III | |
| 5,897,926 | A | 4/1999 | Mikulas | |
| 6,067,779 | A | 5/2000 | Weder | |
| 6,561,356 | B2 | 5/2003 | Weder | |
| 6,612,438 | B2 | 9/2003 | Kronenberger | |
| 6,673,422 | B2 | 1/2004 | Weder | |
| 7,308,864 | B1 * | 12/2007 | Catner | 116/173 |
| 2003/0080022 | A1 | 5/2003 | Weder | |

* cited by examiner

*Primary Examiner* — Hemant M Desai
(74) *Attorney, Agent, or Firm* — Parsons & Goltry; Michael W. Goltry; Robert A. Parsons

(57) ABSTRACT

A packing structure, which consists of pliant border having a length, and strips of pliant material attached to the border along the length thereof. The border is attached to itself at a plurality of spaced-apart points forming a lattice, which constitutes a supporting base for the strips of pliant material.

14 Claims, 6 Drawing Sheets

METHOD OF MANUFACTURING PACKING STRUCTURE

FIELD OF THE INVENTION

The present invention relates to packaging and, more particularly, to packing material for use in packaging items in containers and to methods of making packing material.

BACKGROUND OF THE INVENTION

Decorative grass, often referred to as "Easter grass" by those having certain and specific non-secular proclivities, is frequently used to line baskets and other containers to create a cushioned and ornamental nest. The decorative grass nest is intended to make such a container more attractive, and also serves as a support for candy, colored eggs, toys, etc. Decorative grass is fashioned of any one of variety of materials including, for instance, plastic, paper, cellophane, and the like.

Conventional decorative grass is provided in a loose form, which is messy and difficult to manage and contain. In an effort to eliminate these and other problems associated with conventional decorative grass, skilled artisans have devoted considerable time and effort toward decorative grass and other similar packaging forms in which the strips of material are bound together. However exemplary the fruits of these efforts may be, the current improvements to decorative grass and other similar packaging structures suffer in that they are difficult to construct, expensive, and not entirely aesthetically attractive. Given the lack of an acceptable solution to problem of loose decorative grass, the continued need for certain new and useful improvements in the art is evident.

SUMMARY OF THE INVENTION

According to the invention, a packaging structure includes a pliant border, and strips of pliant material attached to the border. The border is attached to itself at a plurality of spaced-apart points forming a lattice comprising a supporting base for the strips of pliant material, according to the principle of the invention. The border has a length, and the strips are attached to the border along the length thereof. According to a particular embodiment of the invention there is further provided a receptacle having a closed bottom and an opposing open top, in which the lattice is positioned on the closed bottom and the strips are disposed atop the lattice projecting upwardly toward the open top of the receptacle. Preferably, the closed bottom and the lattice are substantially coextensive. In a particular embodiment, the lattice has a width and a length, and the width of the lattice is substantially equal to the length of the lattice. In another embodiment, the lattice is generally circular in shape resembling a rosette.

According to the invention, a method includes providing a pliant border and a plurality of strips of pliant material attached to the border, and attaching the border to itself at a plurality of spaced-apart points forming a lattice constituting a supporting base for the strips of pliant material. The border has a length, and the strips are attached to the border along the length thereof. In a particular embodiment, providing the pliant border and the plurality of strips of pliant material attached to the border includes providing a plurality of superimposed sheets defining opposed first and second edges, joining the plurality of sheets together adjacent the first edge forming a border at the first edge, and forming spaced-apart substantially parallel cuts in the sheets extending from the second edge to adjacent the border. The method further includes providing a receptacle having a closed bottom and an opposing open top, and positioning the lattice on the closed bottom, in which the strips are disposed atop the lattice projecting upwardly toward the open top of the receptacle. Preferably, the closed bottom and the lattice are substantially coextensive. In a particular embodiment, the lattice has a width and a length, and the width of the lattice is substantially equal to the length of the lattice. In another embodiment, the lattice is generally circular in shape resembling a rosette.

According to the invention, a method includes providing a plurality of superimposed pliant sheets, joining the sheets together at an edge thereof, each of the sheets having a plurality of strips extending from the edge, and attaching the edge to itself at a plurality of spaced-apart points forming a lattice constituting a supporting base for the strips of pliant material. The method further includes providing a receptacle having a closed bottom and an opposing open top, and positioning the lattice on the closed bottom, in which the strips are disposed atop the lattice projecting upwardly toward the open top of the receptacle. Preferably, the closed bottom and the lattice are substantially coextensive. In a particular embodiment, the lattice has a width and a length, and the width of the lattice is substantially equal to the length of the lattice. In another embodiment, the lattice is generally circular in shape resembling a rosette. In a particular embodiment, providing a plurality of superimposed pliant sheets includes providing a plurality of superimposed major sheets, and folding the plurality of superimposed major sheets in half at a fold line forming a fold in the major sheets, wherein the sheets consist of opposed superimposed portions of the major sheets. Joining the sheets together at the edge thereof further comprises joining the major sheets together adjacent the fold line.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION OF PREFERRED EMBODIMENTS

Figure 1:
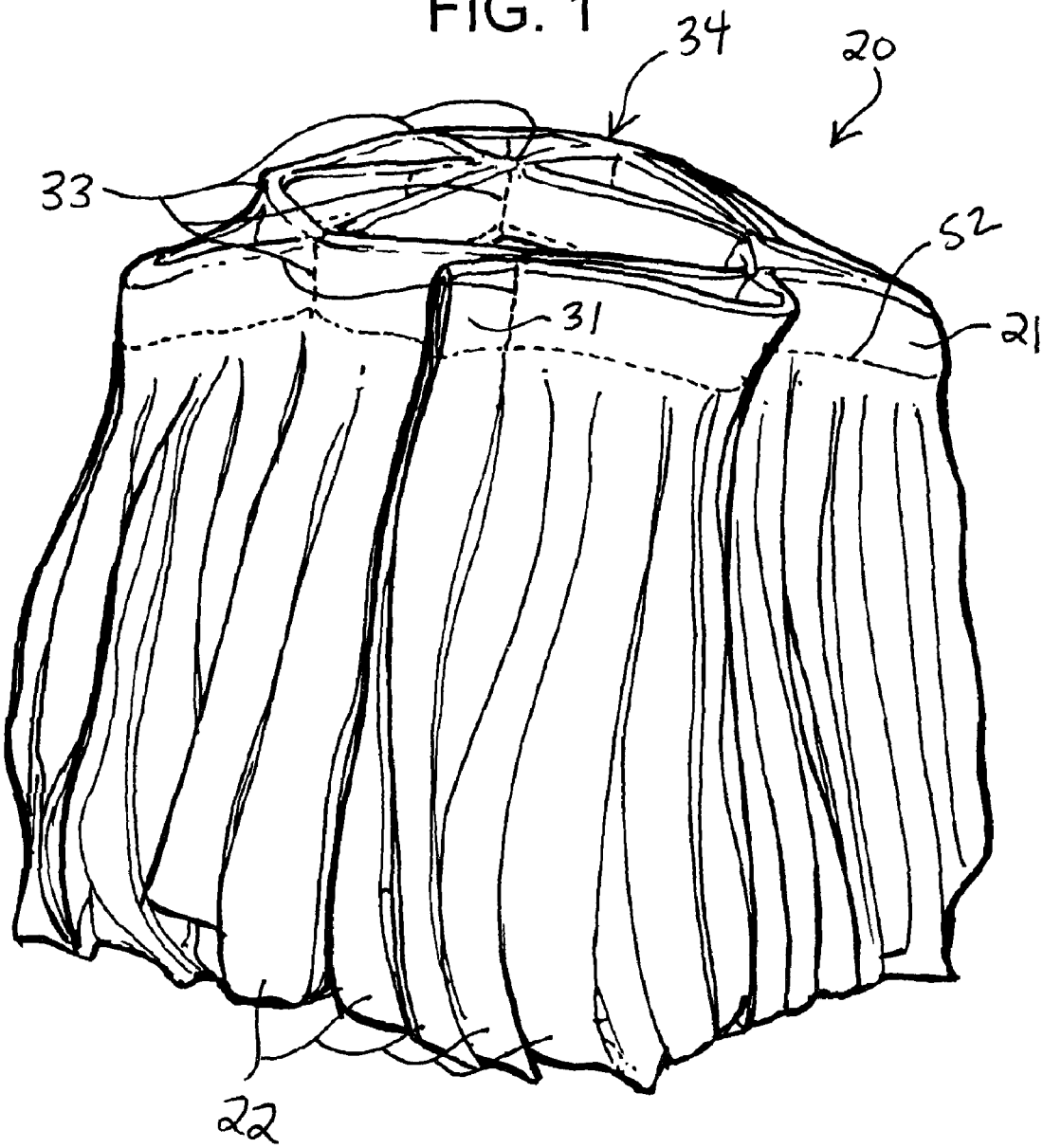
FIG. 1 is a perspective view of a packaging structure constructed and arrange in accordance with the principle of the invention.
Figure 2:
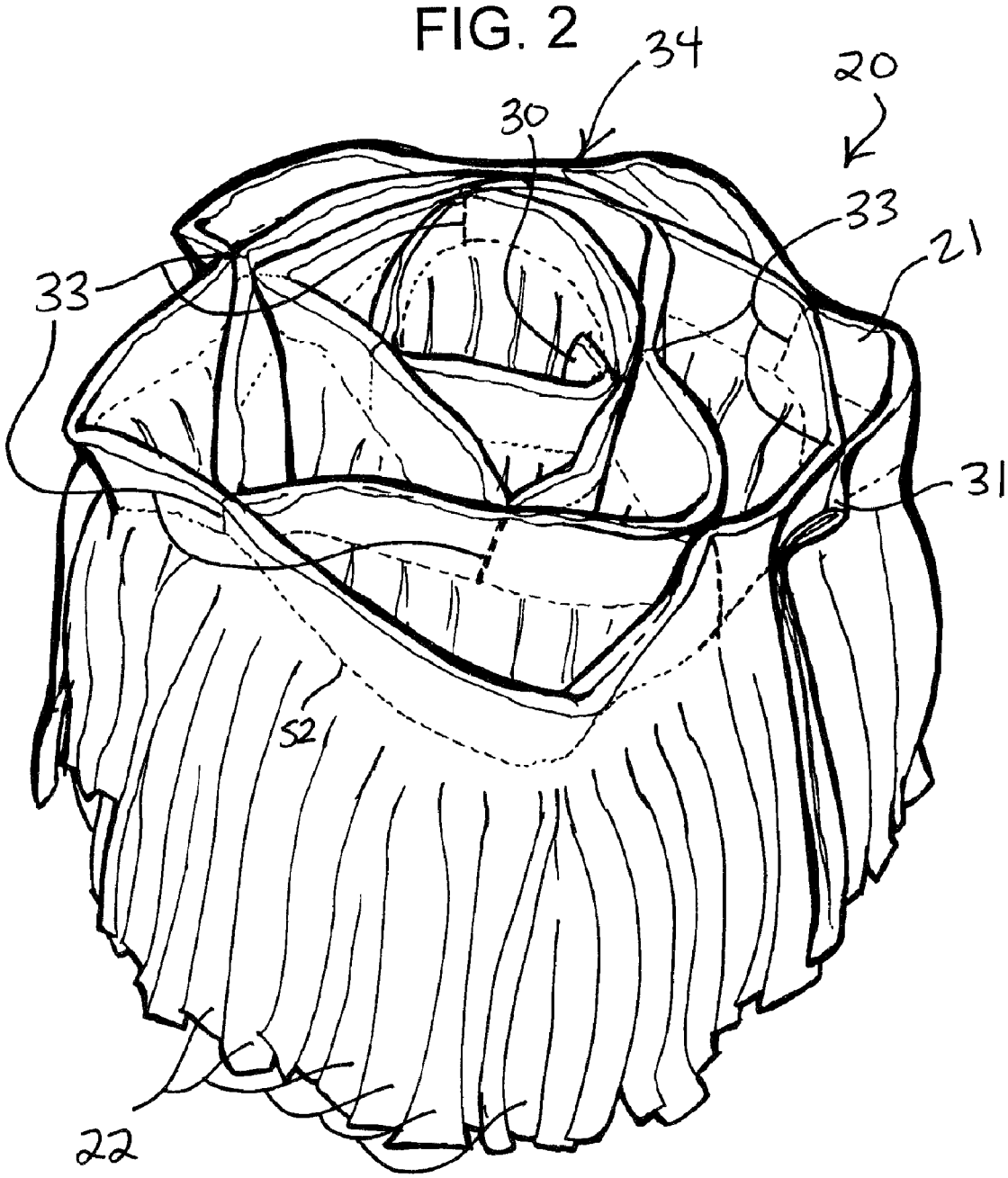
FIG. 2 is a top perspective view thereof.

Turning now to the drawings, in which like reference characters indicate corresponding elements throughout the several views, attention is first directed to FIGS. 1 and 2 illustrating perspective views of a packing structure 20 including a border 21 and strips 22 attached to and depending from border 21, in accordance with the principle of the invention. Border 21 and strips are each fashioned of cloth, plastic, polyethylene, or other similarly pliant material or combination of materials being flexible and easily manipulated or influenced, in accordance with the principle of the invention.

Although border 21 and strips 22 can be made of any suitably pliant material or combination of materials, the preferred material of construction is cloth or cloth-like material, such as woven or unwoven cotton, wool, polyester, nylon, a selected blend of two or more of the foregoing cloth materials, or the like.

Figure 3:
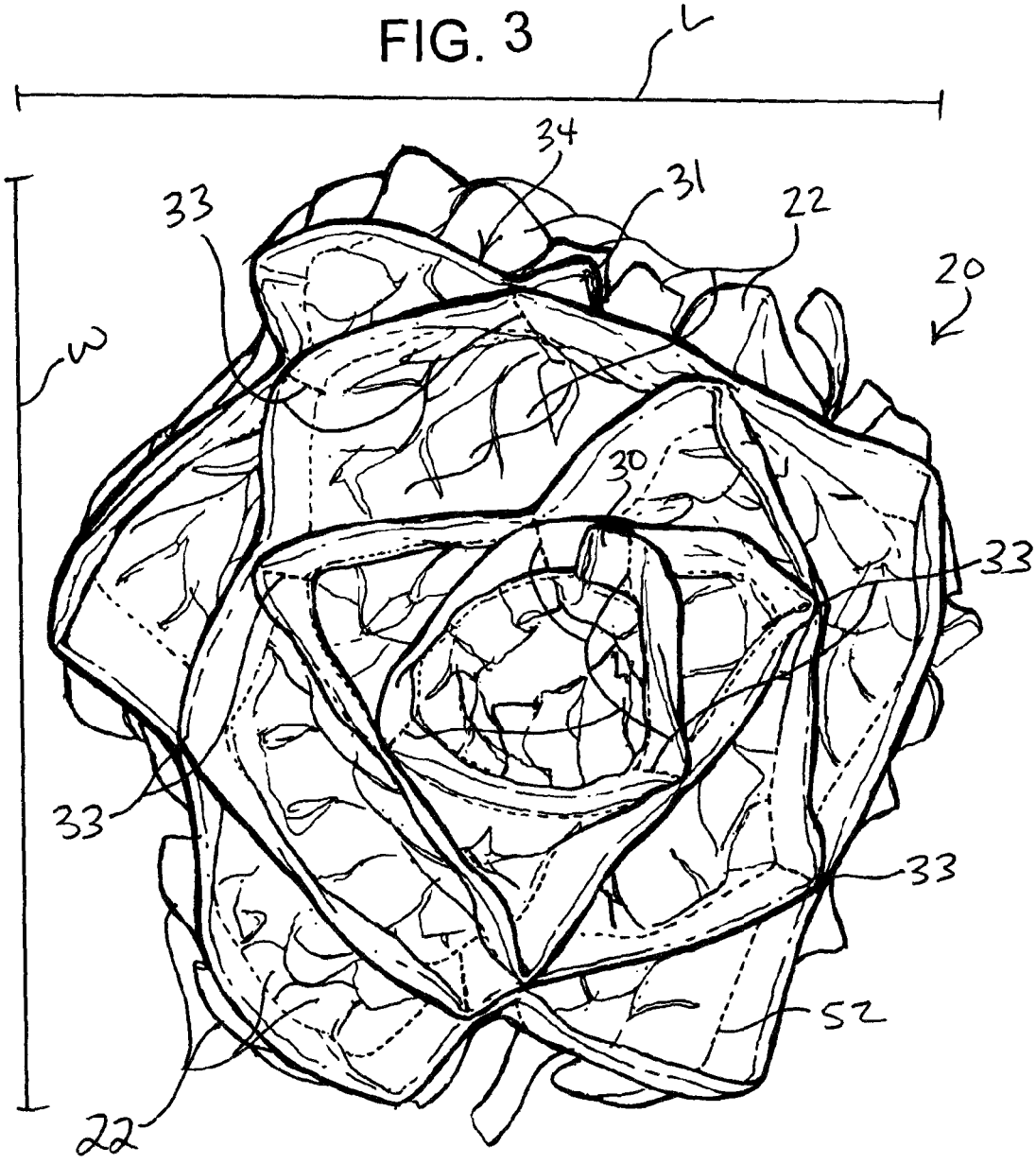
FIG. 3 is a top plan view thereof.

With continuing reference to FIG. 2, and additional regard to FIG. 3, which is a top plan view of packing structure 20, border 21 is elongate and has an inner end 30 and an opposing outer end 31. Strips 22 are not only attached to and depend from border 21, but are also present along the entire length of border 21 from inner end 30 to outer end 31 as shown. Border 21 and strips 22 can, if desired, be provided as separate components, and strips 22 attached to border 21 by means of sewing, glue, heat bonding, etc. According to the principle of the invention, border 21, with strips 22 attached thereto and depending therefrom, is wound about itself substantially forming a helix of generally concentric helical rings, and border 21 is attached/secured to itself at a plurality of spaced-apart attachment points 33 between its inner and outer ends 30 and 31 forming a lattice 34, which constitutes the supporting base for strips 22. In this embodiment, lattice 34 is generally round/circular generally resembling a rosette. Lattice 34 binds strips 22 together.

As referenced in FIG. 3, lattice 34 has a width W and a length L. In the preferred embodiment set forth herein, width W of lattice 34 is substantially equal to length L of lattice 34, in which lattice 34 is made to occupy a relatively wide area and thus spreading strips 22 across an equally wide area. Although in the preferred embodiment lattice 34 is generally circular resembling a rosette, lattice 34 can, if desired, be constructed and arranged to resemble other lattice shapes.

The relative shape of lattice 34 is determined by the length of border 21, the way in which border 21 is wound about itself or otherwise passed or folded relative to itself, and the arrangement and number of spaced-apart attachment points 33. In the preferred embodiment as previously discussed, border 21 is wound about itself substantially forming a helix and then attached to itself at points 33 thus forming the generally circular/rosette overall shape as seen in FIG. 3. According to this disclosure, it is to be understood that border 21 may be wound about itself or otherwise passed or folded relative to itself in whatever desired way, and then attached to itself at spaced-apart attachment points between its inner and outer ends 30 and 31 in whatever pattern and/or spacing so as to form a lattice having whatever desired or specified shape so as to form the supporting base for strips 22. Further suitable shapes for lattice 34 can include a round pattern, an oval pattern, a grid pattern, a checkerboard pattern, a zigzag pattern, a square pattern, a triangular pattern, a rectangular pattern, etc.

Figures 4, 5:
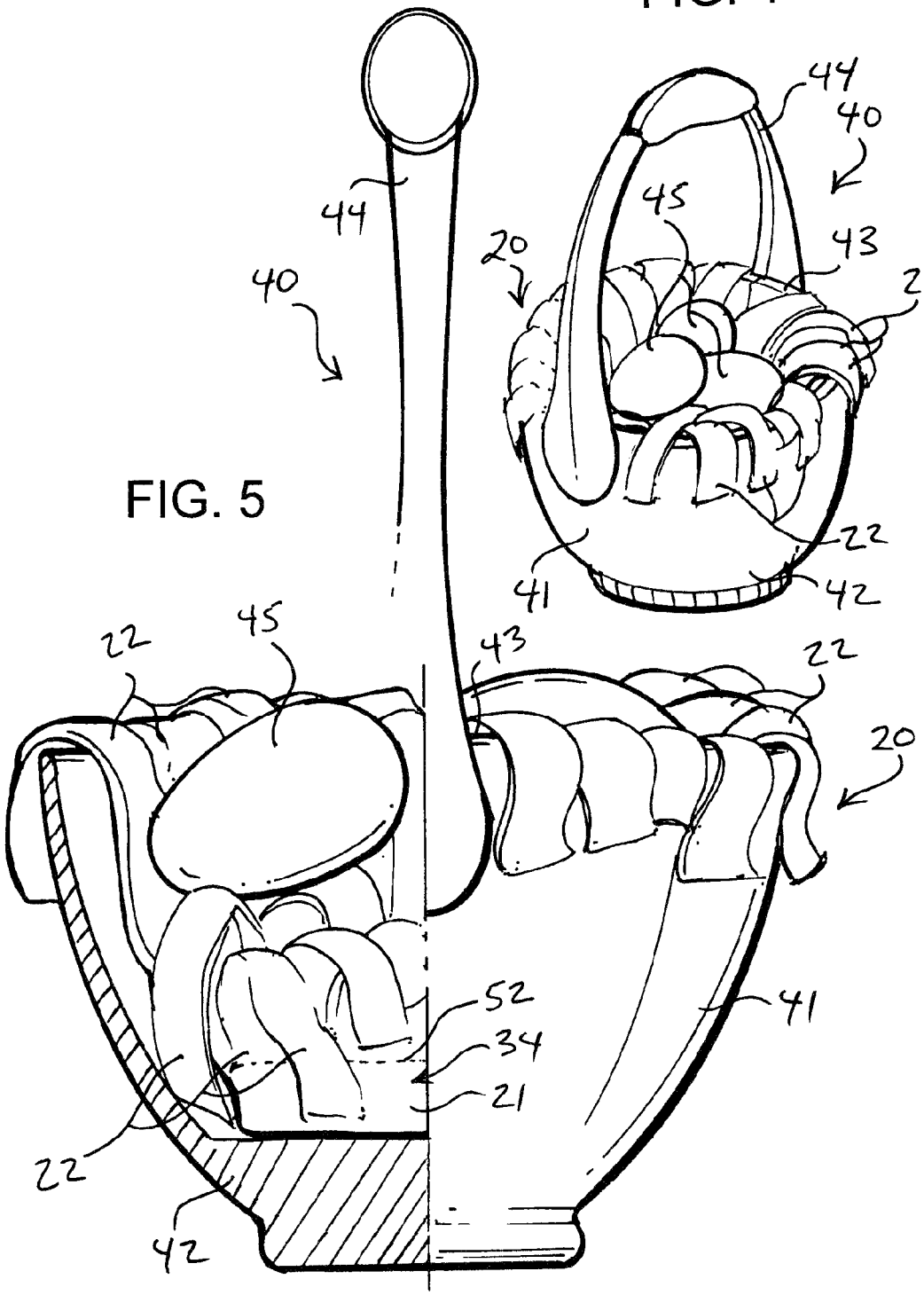
FIG. 4 is perspective view of a receptacle incorporating the packaging structure of FIG. 1.
FIG. 5 is a side elevational view of the receptacle of FIG. 4 incorporating the packaging structure of FIG. 1, in which a portion of the receptacle is broken away for illustrative purposes.

Packing structure 20 is used to provide a cushioning support for items placed thereon, and can be used independently if desired. In a particular implementation, which constitutes an embodiment of the invention, support structure 20 is installed into a container or receptacle 40 as shown in FIGS. 4 and 5 to provide a cushioning and decorative support for items placed into receptacle 40. Receptacle 40 consists of a continuous sidewall 41 having a closed bottom 42 and an opposing open top 43. A handle 44 is affixed to sidewall 41 and projects upwardly from and opposes open top 43, and is to be taken up by hand for carrying receptacle 40 from place to place. According to the invention, packaging structure 20 is positioned in receptacle 40, in which lattice 34 is positioned in receptacle 40 and on closed bottom 42, and strips 22 are disposed atop lattice 34 projecting upwardly toward open top 43 of receptacle 40 as substantially shown. Being disposed atop lattice 34, strips 22 together form a cushioning support onto which items may be placed for safekeeping. In this embodiment, receptacle 40 is exemplary of a basket, in which packaging structure 20 functions essentially as artificial grass as exemplified by strips 22 onto which eggs 45, candy, and/or other selected objects may be set and displayed.

Preferably, closed bottom 42 and lattice 34 are substantially coextensive for allowing packaging structure 34 to provide the desired cushioning for closed bottom 42. Furthermore, strips 22 are closely arranged and the population of strips 22 is sufficiently large so that they may together function as a cushioning support, in accordance with the principle of the invention. The rosette/circular shape of lattice 34 is desirable, as this shape allows lattice 34 to be "telescoped" from its center allowing it and its outer edges or extremities to settle onto and conform to the interior surface of the closed bottom of a container or receptacle into which it is set. And so the provision of lattice 34 functions to permit lattice 34 to be readily conformable to the interior surface of closed bottom 42 of receptacle 40, or to the closed bottom of whatever receptacle is placed against.

Figure 6:
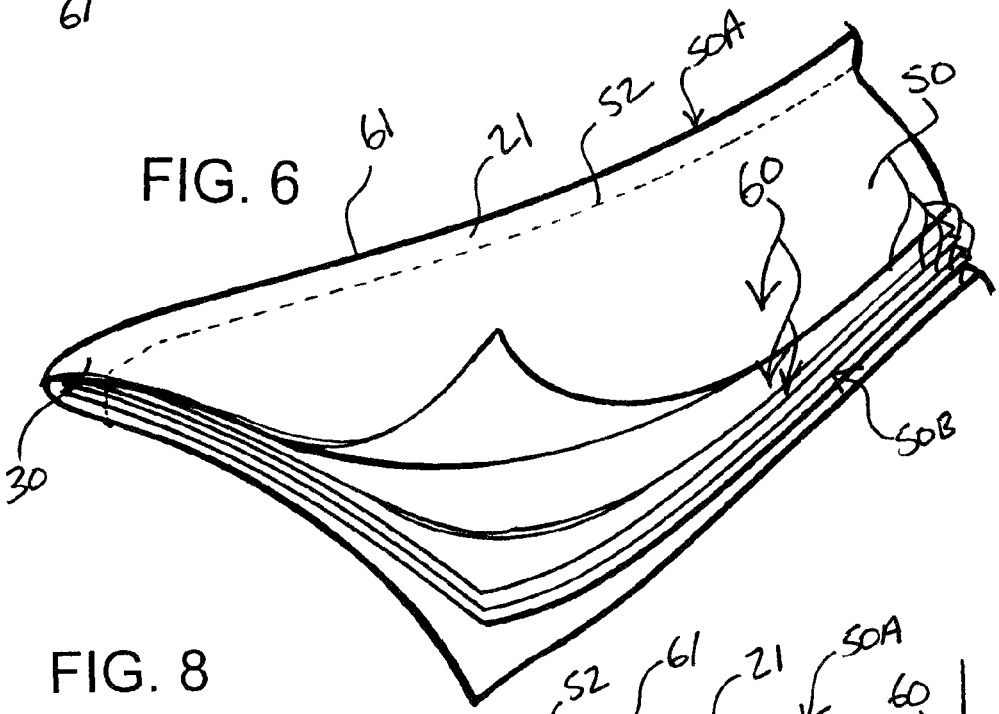

Having described the basic structure of packaging structure 20, a preferred method of manufacturing packaging structure 20 will now be discussed in conjunction with FIGS. 6-9. Referring first to FIG. 6, a preferred method begins with providing a plurality of superimposed sheets 50 of pliant material each having a length and which together form opposing edges 50A and 50B, and joining sheets 50 together adjacent edge 50A forming border 21. Edge 50A is considered a hemmed or bound edge, which characterizes the formation of border 21. Border 21 has a length, which is defined by the length of sheets 50. FIG. 6 is a fragmented perspective view of sheets 50 showing inner end 30 of border 21.

As a matter of example, sheets 50 are joined together adjacent edge 50A by sewing to form border 21 as evidenced by sewn feature 52 in the present embodiment, which extends concurrently with edge 50A. According to the skill attributed to the skilled artisan, it will be readily understood that sheets 50 can be joined or otherwise bound or bonded together at edge 50A in other ways so as to form border 21 bonding sheets 50 together, such as by gluing, heat bonding, pinning, binding, clipping, etc. Preferably, sheets 50 are substantially coextensive relative to one another. Sheets 50 can, however, be differently sized, if desired.

Figure 7:
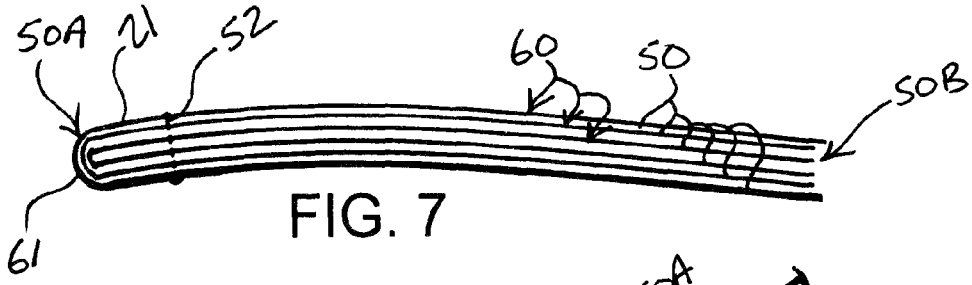
FIGS. 6-9 illustrate steps of manufacturing the packaging structure of FIG. 1.

To provide the plurality of superimposed sheets 50, sheets 50 can, in a particular embodiment, be provided as separate sheets that are simply superimposed atop one another. Another way of providing the plurality of superimposed sheets 50 includes providing a plurality of superimposed major sheets 60, being preferably substantially coextensive, and folding the plurality of superimposed major sheets 60 in half at a fold line 61 as shown in FIGS. 6 and 7 forming a fold in major sheets 60, in which sheets 50 consist of the opposed superimposed portions or halves of major sheets 60 on either side of fold line 61. In this embodiment, edge 50A is a folded edge of the plurality of superimposed major sheets 60. As seen in FIGS. 6 and 7, three (3) major sheets 60 are used and folded to form a total of six (6) superimposed sheets 50. It is to be understood that less or more major sheets 60 may be used for provided the desired number of sheets 50 without departing from the invention.

Figure 8:
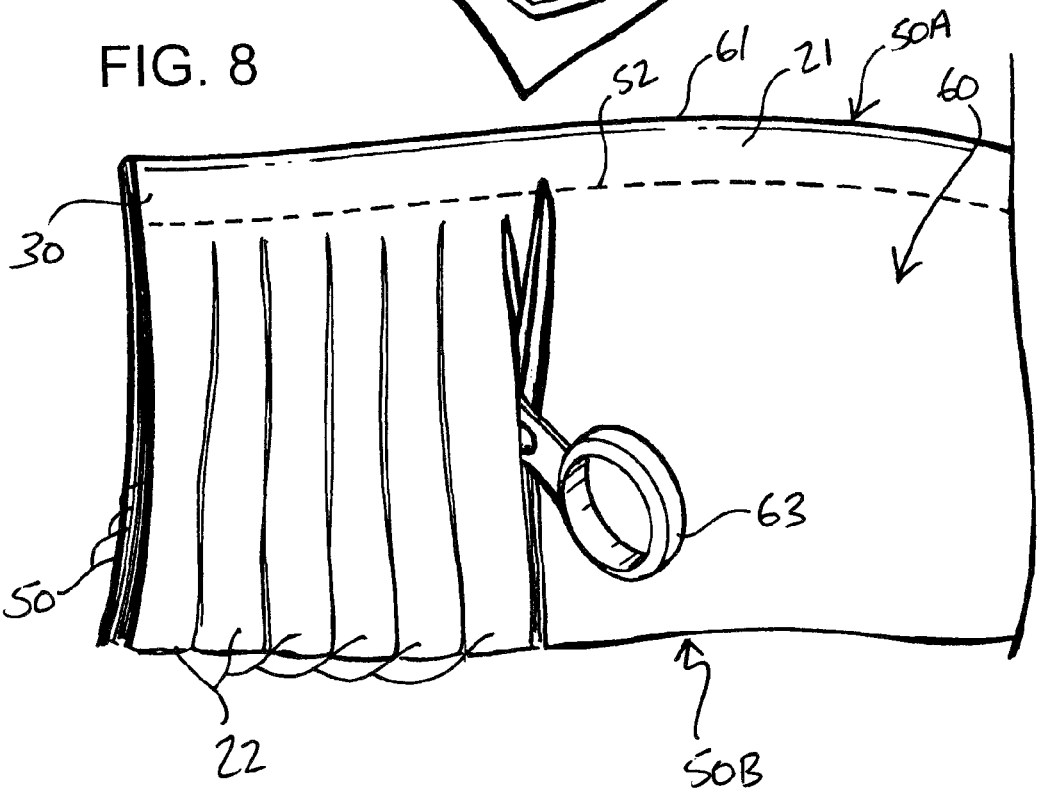

Referring now to FIG. 8, the method next includes providing/forming strips 22 in sheets 50 by forming spaced-apart substantially parallel cuts 62 into sheets 50 extending from edge 50A to adjacent border 22 and, moreover, to just inboard of the attachment point of sheets 50, which is represented by sewn feature 52 in this embodiment and so leaving border 21 intact. Cuts 62 are formed into sheets 50 along the full length of border 21 and at spaced intervals, thus forming a series of sets of strips 22 in sheets 50, which are attached to and supported by border 21 and preferably extend along the entire length of border 21. Cuts 62 are formed through sheets 50 by cutting with scissors 63 or other suitable cutting instrument.

Figure 9:
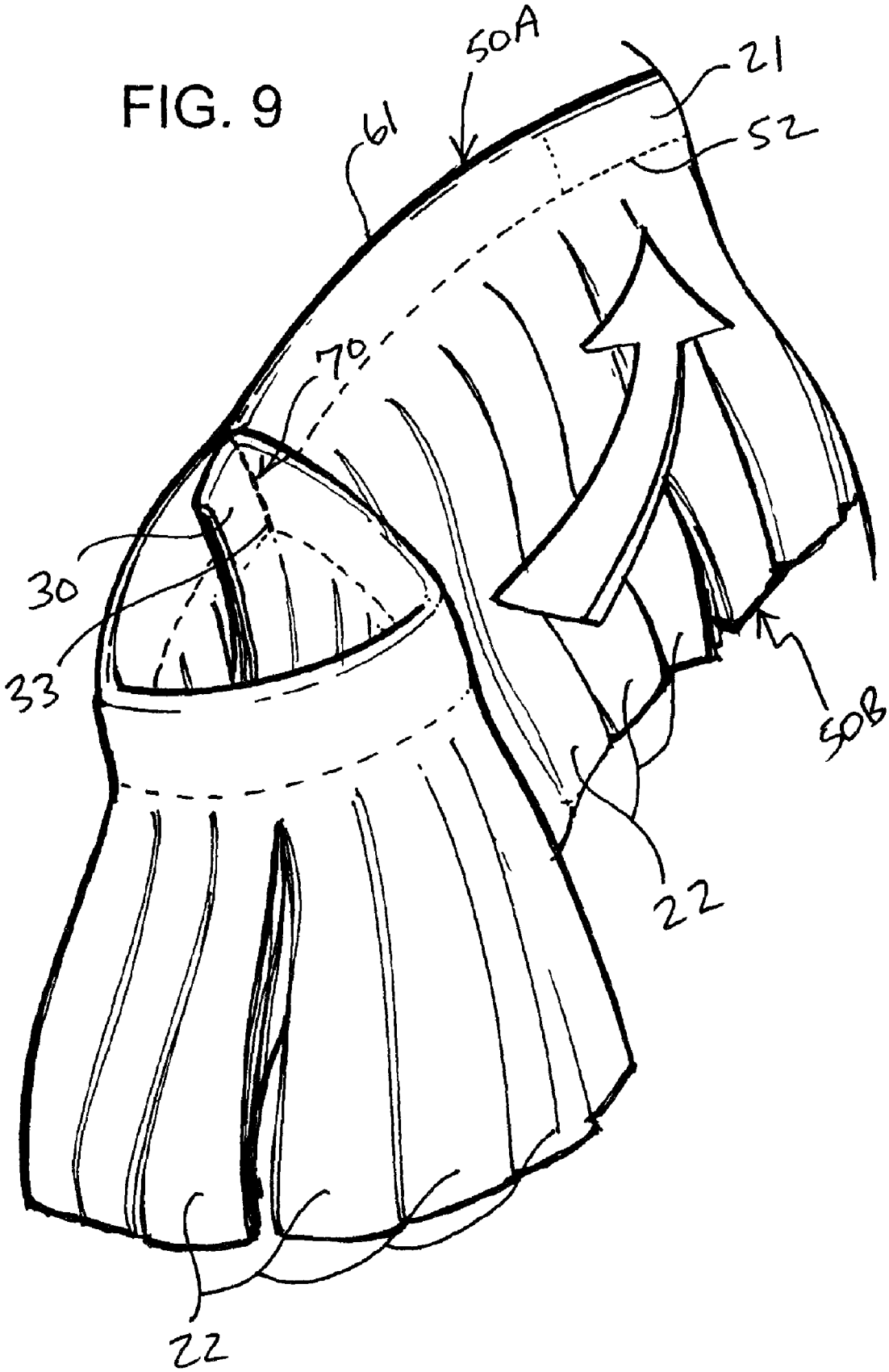

After providing strips 22 attached to border 21 as substantially represented in FIG. 8, the method next includes attaching border 21 to itself at spaced-apart points 33 forming lattice 34 comprising the supporting base for strips 22 as shown in FIGS. 2 and 3, in accordance with the principle of the invention. To illustrate this aspect of the invention, reference is now made to FIG. 9 which illustrates border 21 including strips 22 depending therefrom, in which inner end 30 of border 21 is shown as it would appear having been folded back onto a standing portion of border 21 and than attached thereto at a first attachment point 33. To form this first attachment point 33, border 21 is joined to itself by sewing as evidenced by sewn feature 70 in the present embodiment. According to the skill attributed to the skilled artisan, it will be readily understood that border 21 can be joined or otherwise bound or bonded to itself to form an attachment point in other ways, such as by gluing, heat bonding, pinning, binding, clipping, etc. After the first attachment point 33 is formed as shown in FIG. 9 forming a base loop 71 in border 21, the process of folding and/or wrapping border 21 onto itself and fastening it to itself at spaced-apart attachment points 33 is continued repeatedly until reaching and attaching outer end 31 to border 21 as shown in FIGS. 2 and 3, in which the method ends after outer end 31 is attached to border 21 at the last attachment point 33 completing the formation of lattice 34 and packaging structure 20.

In the present embodiment as previously explained, border 21 is wound about itself in the form of a helix, in which attachment points 33 cooperate to form lattice 34 in the shape of a circle/rosette. Again, it is to be understood that border 21 be any length, and that any number of spaced-apart attachment points 33 of border 21 to itself may be provided for providing the desired form of lattice 34. Strips 22 are preferably substantially identical in length in a preferred embodiment of packaging structure 20, although it is to be understood that strips 22 can be provided in different lengths or varying or random lengths. Furthermore, strips 22 are preferably substantially identical in width in a preferred embodiment of packaging structure 20, although it is to be understood that strips 22 can be provided in different widths or varying or random widths. Also, strips 22 can be provided in any suitable shape, in which the shape of strips 22, like the shape of lattice 34, will typically depending on specific user needs and requirements for intended use.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same.

The invention claimed is:

1. A method comprising steps of:

providing a pliant border having opposed first and second ends and a plurality of strips of pliant material attached to the border; and folding the border back upon itself and attaching the border to itself at a plurality of spaced-apart points between the opposed first and second ends forming a lattice comprising a supporting base for the strips of pliant material.

2. The method according to claim 1, further comprising:

the pliant border having a length; and the strips of pliant material attached to the border along the length thereof.

3. The method according to claim 1, wherein the step providing the pliant border and the plurality of strips of pliant material attached to the border comprises:

providing a plurality of superimposed sheets defining opposed first and second edges;

joining the plurality of sheets together adjacent the first edge forming a border at the first edge; and forming spaced-apart substantially parallel cuts in the sheets extending from the second edge to adjacent the border.

4. The method according to claim 1, further comprising:

providing a receptacle having a closed bottom and an opposing open top; and positioning the lattice on the closed bottom;

the strips disposed atop the lattice projecting upwardly toward the open top of the receptacle.

5. The method according to claim 4, wherein the closed bottom and the lattice are substantially coextensive.

6. The method according to claim 1, further comprising:

the lattice having a width and a length;

wherein the width of the lattice is substantially equal to the length of the lattice.

7. The method according to claim 1, wherein the lattice is generally circular in shape.

8. A method comprising steps of:

providing a plurality of superimposed pliant sheets;

joining the sheets together at an edge thereof forming a border;

each of the sheets having a plurality of strips extending from the border; and attaching the border to itself at a plurality of spaced-apart points forming a lattice comprising a supporting base for the strips of pliant material.

9. The method according to claim 8, further comprising:

providing a receptacle having a closed bottom and an opposing open top; and positioning the lattice on the closed bottom;

the strips disposed atop the lattice projecting upwardly toward the open top of the receptacle.

10. The method according to claim 9, wherein the closed bottom and the lattice are substantially coextensive.

11. The method according to claim 8, further comprising:

the lattice having a width and a length;

wherein the width of the lattice is substantially equal to the length of the lattice.

12. The method according to claim 8, wherein the lattice is generally circular in shape.

13. The method according to claim 8, wherein the step of providing a plurality of superimposed pliant sheets comprises:

providing a plurality of superimposed major sheets; and folding the plurality of superimposed major sheets in half at a fold line;

wherein the sheets comprise opposed superimposed portions of the major sheets.

14. The method according to claim 13, wherein the step of joining the sheets together at the edge thereof further comprises joining the major sheets together adjacent the fold line.

* * * * *